US007788760B2

(12) United States Patent
Schneble

(10) Patent No.: US 7,788,760 B2
(45) Date of Patent: Sep. 7, 2010

(54) TRANSFER TOOL

(75) Inventor: Martin A. Schneble, Bellbrook, OH (US)

(73) Assignee: Schneble Tools L.L.C., Waynsville, OH (US)

( * ) Notice: Subject to any disclaimer, the term of this patent is extended or adjusted under 35 U.S.C. 154(b) by 1080 days.

(21) Appl. No.: 11/358,655

(22) Filed: Feb. 21, 2006

(65) Prior Publication Data

US 2006/0185111 A1 Aug. 24, 2006

Related U.S. Application Data

(60) Provisional application No. 60/655,222, filed on Feb. 22, 2005.

(51) Int. Cl.
*B26B 3/00* (2006.01)
*A47L 17/06* (2006.01)

(52) U.S. Cl. ..... 15/236.07; 15/236.01

(58) Field of Classification Search ..... 15/236.01, 15/236.07; 294/55; 30/169
See application file for complete search history.

(56) References Cited

U.S. PATENT DOCUMENTS

| | | | | | |
|---|---|---|---|---|---|
| 4,888,846 | A * | 12/1989 | Natale | 15/236.01 |
| 4,987,635 | A * | 1/1991 | Young | 15/236.01 |
| D506,114 | S * | 6/2005 | Majeski | D8/45 |
| 2006/0073279 | A1 * | 4/2006 | Nistico | 427/355 |

* cited by examiner

*Primary Examiner*—Shay L Karls
(74) *Attorney, Agent, or Firm*—Joseph G. Nauman

(57) ABSTRACT

A tool is provided for use in removing pliable surface compounds from a container and efficiently transferring the compound to a tray or the like. The tool comprises a handle having a longitudinal axis and having first and second ends. The tool also includes a blade secured to the first end of the handle and having first and second adjacent sections. The first section of the blade defines a generally planar controlling section and the second section of the blade defines a generally planar working section, wherein the plane of the second section extends at an acute angle relative to the plane of the first section. The second section defines a contoured edge of predetermined curvature corresponding to the curvature of the container such that the blade can be used to remove surface compounds from the container.

4 Claims, 3 Drawing Sheets

TRANSFER TOOL

CROSS-REFERENCE TO RELATED APPLICATION

This application is based upon, and claims the priority of, prior U.S. Provisional Application Ser. No. 60/655,222 filed 22 Feb. 2005, and incorporates herein by reference the entire disclosure of that application.

FIELD OF THE INVENTION

The present invention relates to tools for pliable surface compounds used in dry wall construction and/or repair, and more particularly, to tools for transferring surface compounds from a container used for mixing and storing the compounds, into a pan or a so-called 'hawk', or other application devices.

BACKGROUND OF THE INVENTION

A wide variety of tools, sometimes referred to as wallboard taping knives, are used to apply surface compounds, such as pliable plaster or joint or spackling compounds, to cover joints, edges, etc., between pieces of wallboard (e.g., gypsum plaster board) during drywall construction or to repair wall board in the event of damage. These tools consist of a relatively wide, planar and thin blade, usually made of an appropriate steel, with a manipulating handle attached to the blade and extending from the rear edge of the blade, opposite its working edge. The blade is flexible to allow the working edge to apply, spread, shape and smooth surface compounds so that the compound dries as a near-finished part of the wallboard surface. Thereafter, the dried compound can be lightly sanded (if desired) to present a smooth continuous surface over the installed or repaired wallboard.

A user will typically remove a desired amount of surface compound from a mixing or storage container and then deposit the compound on a tray or a pan, commonly referred to as a "hawk," which is held by the user in one hand while he/she uses a conventional wallboard taping knife in the other hand to remove compound from the tray and apply the compound to a wallboard surface. While the flexible, planar blades of wallboard taping knives are useful for applying, spreading, shaping and smoothing surface compounds onto wallboard surfaces, it can be difficult to remove the compounds from mixing or storage containers using the blades of these conventional knives. As a result, surface compound is often wasted because it dries inside the mixing or storage container. In addition, attempts at removing the compound from the mixing or storage container sometimes results in compound getting on the handle of the knife and on the user's hands.

There have been a number of attempts at addressing the problems associated with conventional surface compound tools. For example, U.S. Pat. Nos. 5,624,145 to Swilley; U.S. Pat. No. 5,799,997 to Lehn et al.; and U.S. Pat. No. 6,012,227 to Lent describe tools for removing pliable surface compounds from large containers for transfer to a hawk. These tools all have an elongate handle with a hand grip around one end and a scoop base which is fastened to and extends perpendicularly from the other end of the handle. The tool is thrust into surface compound contained within a mixing or storage container, such as a pail or bucket, so that a quantity of the compound is gathered on the scoop base. The tool is then removed from the container by lifting upward on the handle with the scoop following beneath until the scoop clears the top of the container. Then the compound is deposited from the scoop onto a hawk. A curved outer edge of the scoop can be used to scrape material off the side of the container during this process, as necessary. However, even these improved tools for transferring surface compound are awkward to use, particularly with respect to inserting the scoop base and elongate handle into a relatively deep or shallow containers (e.g., the five (5) gallon and one (1) gallon containers, respectively, typically used to store many surface compounds), and the need to translate the scoop base into a relatively vertical position to deposit the surface compound from the scoop base. Although the prior art has shown tools somewhat effective in removing compounds from storage containers, those prior art tools cannot easily transfer compounds used in pliable spackling compounds and the like.

Accordingly, there remains a need for improved tools for transferring surface compounds from the mixing or storage container to a tray for application on a wallboard surface. The improved tool should enable the user to easily and efficiently remove the desired amount of compound from the container while minimizing the amount of wasted compound on the inside surface of the container and the inadvertent transfer of compound from the container wall to the tool handle or hand of the user. In addition this improved tool has a relatively wide blade for removing substantial amounts of compound, without wasting material that may fall off a narrow blade while being transferred. Therefore this tool has additional advantage over tools in the prior art.

SUMMARY OF THE INVENTION

The present invention disclosed herein provides a tool for use in removing surface compounds from a container. According to one embodiment, the tool comprises a handle having a longitudinal axis and having first and second ends. In one embodiment, the handle defines at least one aperture at the second end of the handle so that the tool may be hung on a hook or nail on a wall, etc. The tool includes a blade secured to the first end of the handle, wherein the blade extends from the handle at an acute angle relative to the longitudinal axis of the handle. In one embodiment, the acute angle between the blade and the longitudinal axis of the handle is about 25°. The blade preferably defines a contoured edge of predetermined curvature corresponding to the curvature of the container such that the blade can be used to remove surface compounds from the container. In one embodiment, the tool includes a blade holder attached to the first end of the handle. The blade holder extends transversely of the first end of the handle, whereby the blade holder functions to attach the blade to the first end of the handle and to stiffen the portion of the blade adjacent the handle.

According to another feature of the present invention, the tool comprises a handle having a longitudinal axis and having first and second ends. The tool also includes a blade secured to the first end of the handle extending across and forward of the handle first end and having first and second adjacent sections. The first section of the blade defines a generally planar controlling section and the second section of the blade defines a generally planar working section terminating at a distal edge, wherein the plane of the second section extends at an acute angle relative to the plane of the first section. In one embodiment, the acute angle between the planes of the first and second sections of the blade is about 25° . The second section defines a contoured distal edge of predetermined contour corresponding to the contour of the container wall such that the blade can be used to remove surface compounds from the container. The longitudinal axis of the handle is within the plane of the first section of the blade. The tool includes a blade holder attached to the first end of the handle. The blade holder extends transversely of the first end of the handle in generally the same plane as the longitudinal axis of the handle. The first section of the blade is secured to the blade holder, whereby the blade holder functions to stiffen the first section of the blade and the portion of the second section of the blade adjacent the handle.

According to still another embodiment of the present invention, there is provided a method of using a tool for removing surface compounds from a container, the method comprising providing a tool having a handle and a blade. The handle has a longitudinal axis and has first and second ends. The blade is secured to the first end of the handle, wherein the blade extends from the handle at an acute angle relative to the longitudinal axis of the handle. The blade defines a contoured edge of predetermined curvature corresponding to the curvature of the container wall. The method includes inserting the blade into the compound contained in the container. The contoured edge of the blade is moved toward the inside surface of the container. Upon contact of the contoured edge of the blade with the inside surface of the container, the tool is lifted out of the container. The method then includes depositing the compound from the blade to a tray.

Accordingly, there is provided an improved tool for transferring surface compounds from the mixing or storage container to a tray for application on a wallboard surface. The improved tool enables the user to easily and efficiently remove the desired amount of compound from the container while minimizing the amount of wasted compound on the inside surface of the container and the inadvertent transfer of compound from the container wall to the tool handle or hand of the user.

BRIEF DESCRIPTION OF THE DRAWINGS

Figure 2:
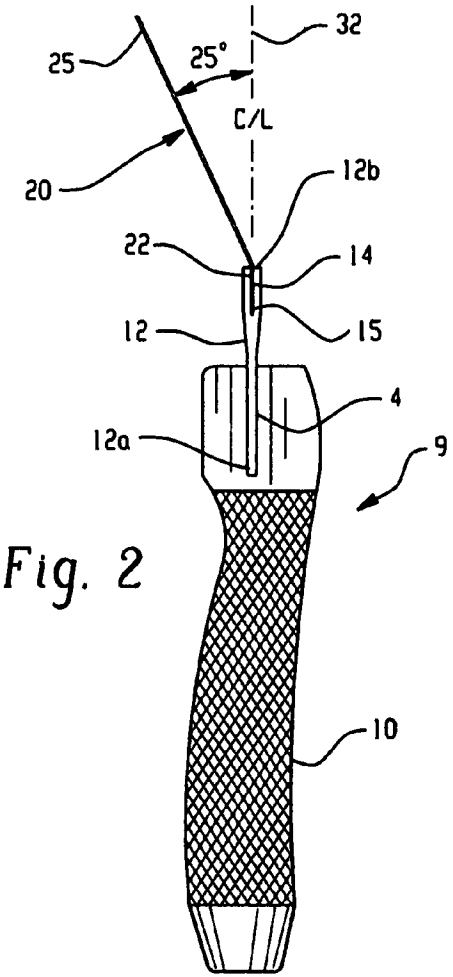
Figure 1:
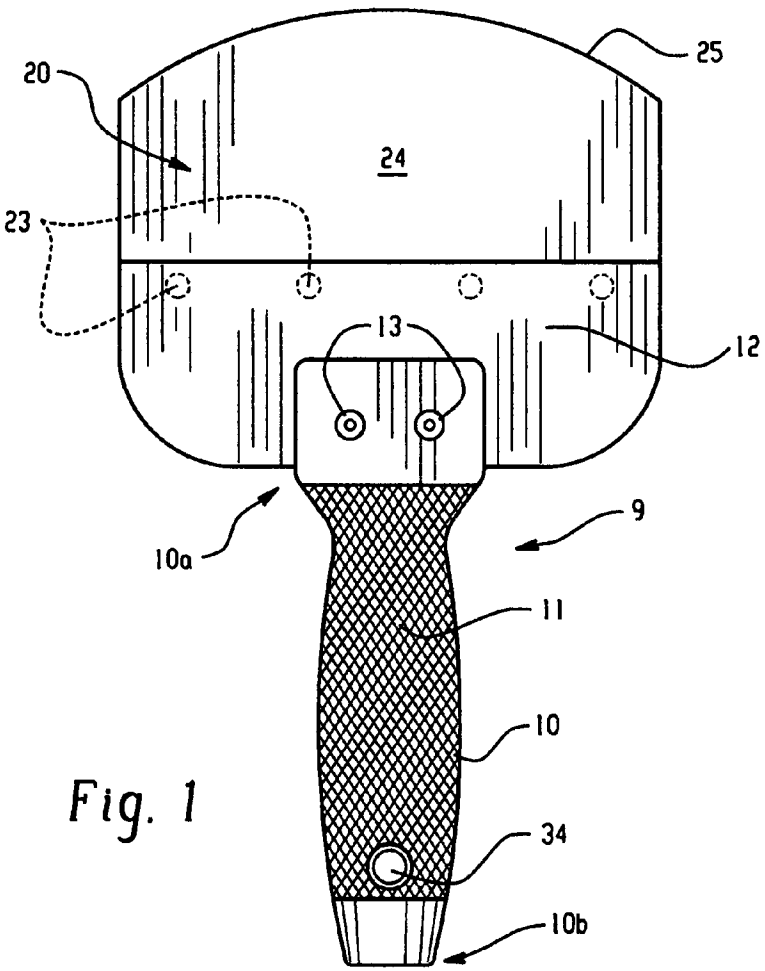
Figure 3:
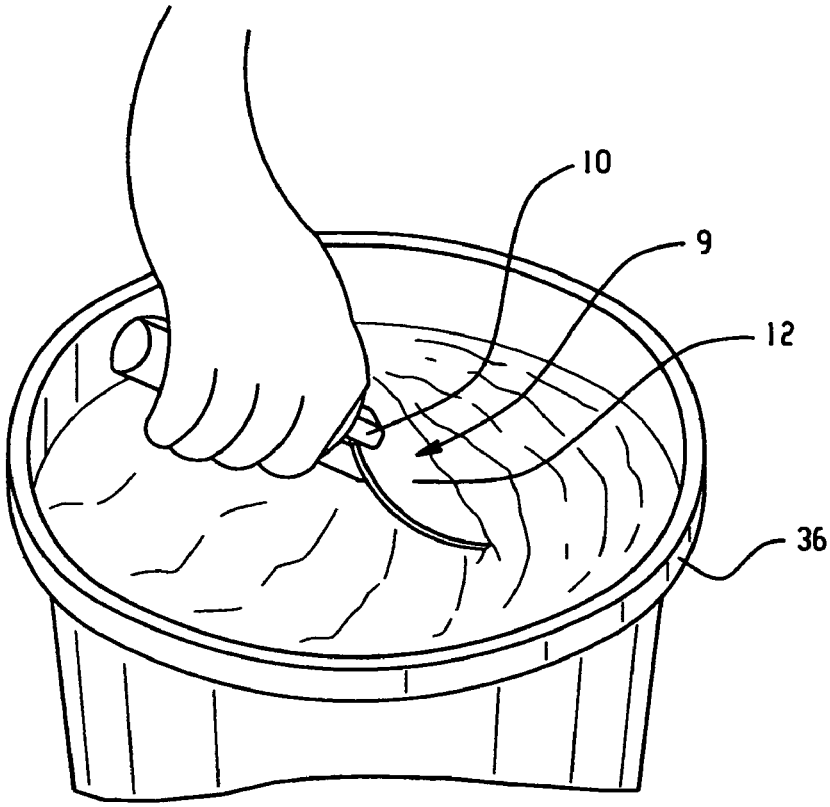
Figure 4:
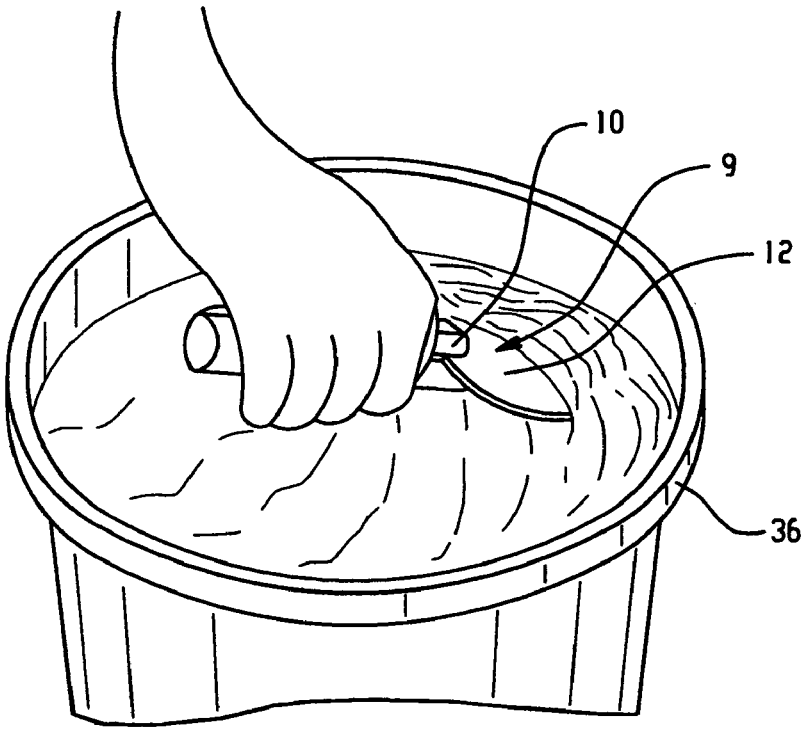
Figure 5:
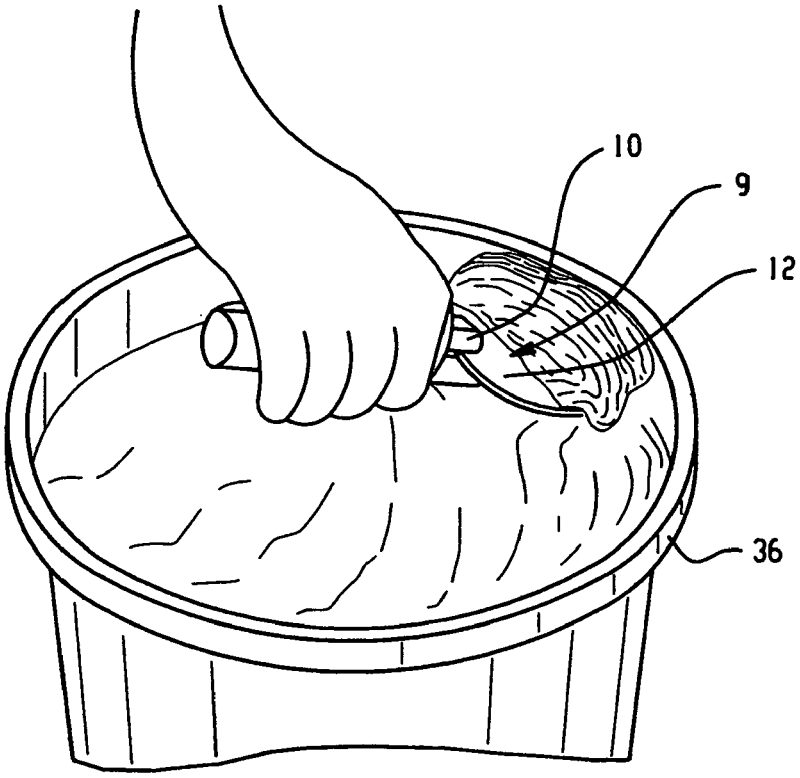
Figure 6:
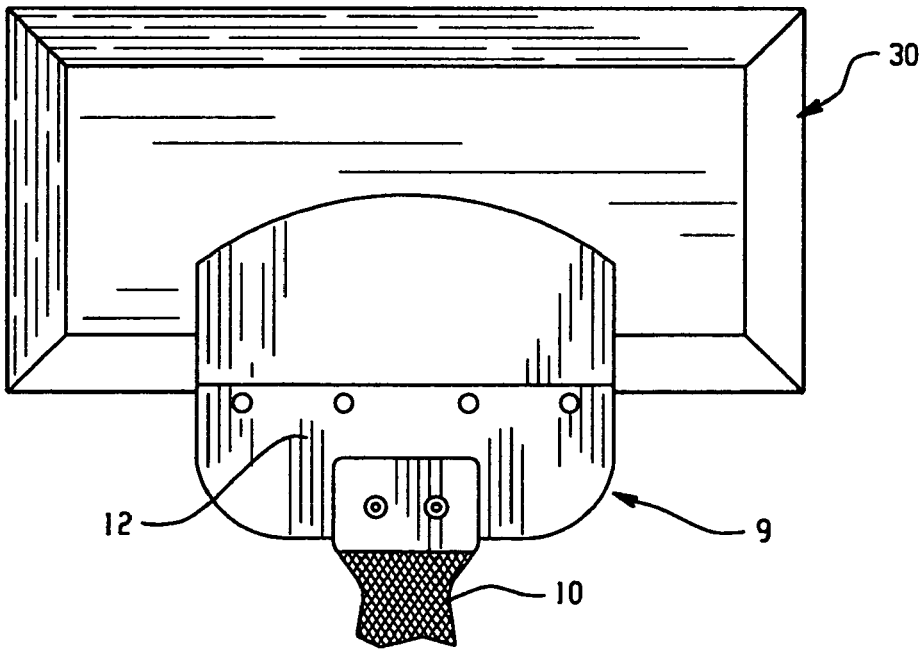

Having thus described the invention in general terms, reference will now be made to the accompanying drawings, which are not necessarily drawn to scale, and wherein:

FIG. 1 is a plan view illustrating a transfer tool, according to one embodiment of the present invention;

FIG. 2 is a side view illustrating the tool as seen from the right side of FIG. 1;

FIGS. 3, 4 and 5 are sequential perspective views illustrating removal of compound from a typical drum-like mixing or storage container, according to one embodiment of the present invention; and;

FIG. 6 is a plan view illustrating an inverted tool, according to one embodiment of the present invention, located over a small pan that may receive surface compound from the transfer tool and be held by a user in one hand while he/she wields a spackling knife with his other hand.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Referring to FIGS. 1 and 2, there is illustrated a transfer tool 9 according to one embodiment of the present invention. The transfer tool 9 includes a handle 10 and a blade 20. The handle 10 can be formed of plastic, wood, metal or other suitable material. In one embodiment, at least a portion of the surface of the handle 10 is textured so as to provide a gripping surface 11, as is well known in the art. The length of the handle can vary depending on the particular size or diameter of the mixing or storage container in which the tool 9 is intended to be used. In one embodiment, the handle is between approximately 5 ½ and 6 ½ inches in length. The handle 10 has first and second ends 10*a*, 10*b* and defines a longitudinal axis or centerline 32. As discussed below, the blade 20 is secured to the first end 10*a* of the handle, either directly or indirectly. The second end 10*b* of the handle 10 can define an aperture 34 at one end so that the transfer tool 9 can be mounted or secured on a hook, nail or the like for purposes of storage, as is well known in the art.

The blade 20 can be formed of plastic or metal, provided the blade is relatively thin and has some flexibility so that the blade will exhibit some elastic deformation when scraped against the side of the tray 30, as illustrated in FIG. 6, when depositing the surface compound into the tray from the blade of the tool 9. In one embodiment, the blade 20 is attached directly to the first end 10*a* of the handle 10 using fasteners, such as screws, rivets, bolts and nuts, etc., or by welding or using adhesives. In another embodiment, the blade 20 is formed integrally with the handle 9. As illustrated in FIG. 2, the blade 20 extends from the handle 10 so as to form an acute angle with the longitudinal axis 32 of the handle. Although the angle can vary depending on the size or diameter of the container, in one embodiment the angle is approximately 20° to 30° and, in another embodiment, is approximately 25°.

The distal edge 25 of the blade 20 is contoured to a predetermined curvature or radius that corresponds to the curvature or radius of a commonly used size of storage or mixing container, such a five (5) gallon or one (1) gallon container. In one embodiment, the radius is about 5.25 inches (about 13.2 mm), which is the radius of a typical bucket-like container (commercially available) containing a supply of about 5 gallons of moist or 'wet' gypsum spackling compound. If the mixing or storage containers are non-cylindrical, the distal edge 25 can be contoured so as to correspond with the contour of the inner surface(s) of such different container.

In one embodiment, as illustrated in FIGS. 1 and 2, the blade 20 is secured to the first end 10*a* the handle 10 indirectly via a blade holder 12. As illustrated in FIG. 2, the first end 10*a* of the handle defines an elongate slot 4. The elongate slot 4 is structured to receive a first end 12*a* of the blade holder 12. The blade holder 12 is secured to the first end 10*a* of the handle 10 via fasteners, such as rivets 13, or via welding or adhesives. The blade holder 12 may also be formed integrally with the handle 10. The blade holder 12 extends away from the first end 10*a* of the handle 10 some predetermined distance, such as 3 ½ to 4 ½ inches. Although the width of the blade holder 12 may vary, in one embodiment as illustrated in FIG. 1, the width of the blade holder is approximately equal to the width of the blade 20, whereby the blade holder stiffens at least the portion of the blade adjacent the blade holder. The center line 32 of the handle 10 preferably is generally aligned and parallel with center line of the blade holder 12.

In one embodiment, as illustrated in FIG. 2, the blade 20 defines first and second adjacent sections 22 and 24. The first section 22 of the blade 20 defines a generally planar controlling section and the second section 24 of the blade defines a generally planar working section. The plane of the second section 24 of the blade 20 preferably extends at an acute angle relative to the plane of the first section 22. In one embodiment, the angle is approximately 20° to 30° and, in another embodiment, is approximately 25°. The second end 12*b* of the blade holder 12 defines a second elongate slot 14 that is structured to receive at least a portion of the first section 22 of the blade 20. The first section 22 of blade 20 may be secured in the elongate slot 14 using fasteners, such as rivets, screws, bolts, etc., by crimping along the length of the slot (as illustrated by the rings 23 in FIG. 1), by welding or using adhesives. Alternatively, the blade 20 can be made integrally with the blade holder 12. The blade holder 12 functions not only to attach the blade 20 to the first end 10*a* of the handle 10, but to also stiffen the first section 22 of the blade and the portion of the second section 24 of the blade adjacent the handle.

Referring to FIGS. 3-6, there are illustrated the steps performed when using the transfer tool 9. As illustrated in FIGS. 3 and 4, the transfer tool 9 is inserted into the compound container 36, and the blade 20 is urged toward the interior surface of the container. As illustrated in FIG. 5, the blade 20 of the tool 9 functions as a scoop enabling the user to collect a desired amount of surface compound from the container 36. Once the distal edge 25 of the blade 20 is against the interior surface of the container 36 the user can remove the surface compound collected on the blade by moving the contoured distal edge of the blade up the interior surface of the container. As illustrated in FIG. 6, the user can then deposit the compound from the blade 20 to a small tray or pan 30 held in the user's other hand. Specifically, the tool 9 can be inverted over pan 30 and the compound dropped into such pan. If any compound sticks to the blade 20, the blade can be scraped against the top edge of the pan 30 to clean any remaining compound from the blade. Advantageously, the tool 9 enables the user to easily and efficiently remove the desired amount of compound from the container 36. The contoured distal edge 25 of the blade 20 minimizes the amount of wasted compound on the inside surface of the container and the angle of the blade relative to the handle maintains the user's hand above the compound thereby minimizing any inadvertent transfer of compound from the container wall to the tool handle or hand of the user.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A tool for use in transferring surface compounds from a supply container, said tool comprising:

a handle having a longitudinal axis and having first and second ends and a blade holder having first and second ends, wherein said second end of said blade holder is directly attached to said first end of said handle, said blade holder having a longitudinal axis that extends transverse to and generally in the same plane of said longitudinal axis of said handle; and a flexible blade having first and second integrally adjacent sections, said first section of said blade defining a generally planar controlling section that is secured to said first end of said blade holder to stiffen said first section of said blade, a plane of said first section is generally parallel to said longitudinal axes of said handle and blade holder, said second section of said blade defining a planar working section, wherein a plane of said second section extends at an acute angle relative to the plane of said first section, a free end of said second section defining a contoured edge of predetermined curvature corresponding to a curvature of a side wall of said supply container.

2. A tool according to claim 1 wherein the acute angle between the planes of said first and second sections of said blade is about 25 degree.

3. A tool according to claim 1 wherein said handle defines at least one aperture at said second end of said handle.

4. A method for using a tool for transferring pliable surface compounds from a supply container, the method comprising:

providing a tool having a handle with a longitudinal axis and having first and second ends and a blade holder having first and second ends, wherein the second end of said blade holder is directly attached to said first end of said handle, said blade holder having a longitudinal axis that extends transverse to and generally in the same plane of said longitudinal axis of said handle; and a flexible blade having first and second integrally adjacent sections, said first section of said blade defining a generally planar controlling section that is secured to said first end of said blade holder to stiffen said first section of said blade, a plane of said first section is generally parallel to said longitudinal axes of said handle and blade holder, said second section of said blade defining a planar working section, wherein a plane of said second section extends at an acute angle relative to the plane of said first section, a free end of said second section defining a contoured edge of predetermined curvature corresponding to a curvature of a side wall of said supply container;

comprising the steps of inserting said blade into said compound contained in the container with said handle of the tool above said compound;

moving said contoured edge of said blade toward an inside surface of the container wall; and upon contact of said contoured edge of the blade with the inside surface of the container, lifting said tool and said compound on the top of said blade upward out of said container; and depositing said compound from said blade onto a tray for subsequent application to a wall surface.

* * * * *